US011013335B2

(12) United States Patent
Chiriac

(10) Patent No.: US 11,013,335 B2
(45) Date of Patent: May 25, 2021

(54) EXPANDABLE SEATING FURNITURE

(71) Applicant: Horatiu Daniel Chiriac, Montreal (CA)

(72) Inventor: Horatiu Daniel Chiriac, Montreal (CA)

(73) Assignee: Horatiu Daniel Chiriac, Montreal (CA)

( * ) Notice: Subject to any disclaimer, the term of this patent is extended or adjusted under 35 U.S.C. 154(b) by 0 days.

(21) Appl. No.: 15/758,502

(22) PCT Filed: Sep. 8, 2016

(86) PCT No.: PCT/CA2016/051057

§ 371 (c)(1),
(2) Date: Mar. 8, 2018

(87) PCT Pub. No.: WO2017/041172

PCT Pub. Date: Mar. 16, 2017

(65) Prior Publication Data

US 2018/0271294 A1 Sep. 27, 2018

Related U.S. Application Data

(60) Provisional application No. 62/215,177, filed on Sep. 8, 2015.

(51) Int. Cl.
*A47C 17/13* (2006.01)
*A47C 11/00* (2006.01)
(Continued)

(52) U.S. Cl.
CPC ..... *A47C 17/13* (2013.01); *A47C 1/124* (2013.01); *A47C 11/005* (2013.01); *A47C 13/005* (2013.01)

(58) Field of Classification Search
CPC ..... A47C 17/13; A47C 11/005; A47C 13/005; A47C 1/124
(Continued)

(56) References Cited

U.S. PATENT DOCUMENTS 371,091 A * 10/1887 Miller ..... B60N 2/3084 297/112
954,594 A * 4/1910 Shaw ..... A47C 7/024 297/107
(Continued)

FOREIGN PATENT DOCUMENTS

CN 101683221 A 3/2010
DE 800426 C * 11/1950 ..... A47C 17/13
(Continued)

*Primary Examiner* — Milton Nelson, Jr.
(74) *Attorney, Agent, or Firm* — Benoit Yelle; Matthew Roy; Gowling WLG (Canada) LLP

(57) ABSTRACT

An expandable seating furniture comprising a center section for providing a first seating position, the center section providing center chair legs and at least one lateral section, concealable into the center section, each of the at least one lateral section being laterally expandable for providing one or more additional seating positions. The center section conceals one or more lateral chair legs, and may also conceal back support and/or armrest, for each of the at least one lateral section when the expandable seating furniture is unexpanded. The lateral section(s) may be concealable into the center section as interleaved sliding sections (e.g., along a seating plane and/or vertically).

16 Claims, 16 Drawing Sheets

(51) Int. Cl.
*A47C 13/00* (2006.01)
*A47C 1/124* (2006.01)

(58) Field of Classification Search
USPC ..... 297/233, 234, 236, 238
See application file for complete search history.

(56) References Cited

U.S. PATENT DOCUMENTS

| | | | | | |
|---|---|---|---|---|---|
| 1,233,419 | A | | 7/1917 | Stoneback | |
| 1,318,569 | A | * | 10/1919 | Kramer | A47C 17/16 5/12.1 |
| 1,449,436 | A | | 3/1923 | Neil | |
| 1,530,420 | A | * | 3/1925 | Schmitt | A47C 17/13 297/107 |
| 2,264,491 | A | * | 12/1941 | Ward | A47C 15/002 297/233 |
| 2,517,037 | A | | 8/1950 | Shaw | |
| 3,710,403 | A | | 1/1973 | Weidner et al. | |
| 3,743,351 | A | | 7/1973 | Harris | |
| 5,660,436 | A | | 8/1997 | Wilson | |
| 2006/0061154 | A1 | | 3/2006 | Kahan | |

FOREIGN PATENT DOCUMENTS

| | | | | | |
|---|---|---|---|---|---|
| DE | 8522893 | U1 | | 12/1991 | |
| DE | 202004009015 | U1 | | 2/2005 | |
| DE | 202004019398 | U1 | | 4/2006 | |
| DE | 202014001827 | | | 8/2014 | |
| GB | 599878 | A | * | 3/1948 | A47C 17/13 |
| JP | 3206089 | U | | 9/2016 | |

* cited by examiner

Detail B

EXPANDABLE SEATING FURNITURE

CROSS REFERENCE TO RELATED APPLICATIONS

The present non-provisional patent application is a U.S. National Phase of International Patent Application PCT/CA2016/051057, filed Sep. 8, 2016, which is hereby incorporated by reference in its entirety and which claims priority based upon the prior U.S. provisional patent application entitled "EXPANDABLE CHAIR", application No. 62/215,177, filed Sep. 8, 2015, in the name of CHIRIAC, Daniel, which is incorporated herein by reference in its entirety.

TECHNICAL FIELD

The present invention relates to seating furniture and, more specifically, to transformable seating furniture.

BACKGROUND

Some chairs can to be transformed forward into a bed. Some sofas can also be transformed forward into a bed. Once transformed into a bed, sitting becomes uncomfortable.

Foldable chairs take space when not in use and also cannot be used when folded. Stackable chairs cannot be used when stacked and take space.

The present invention addresses at least some of these shortcomings.

SUMMARY OF INVENTION

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A first aspect of the present invention is directed to an expandable seating furniture comprising a center section providing one or more first seating positions and the center section providing center chair legs and at least one lateral section, concealable into the center section. Each of the at least one lateral section is laterally expandable for providing one or more additional seating positions. The center section conceals one or more lateral chair legs for each of the at least one lateral section when the expandable seating furniture is unexpanded.

Optionally, the at least one lateral section comprises two or more interleaved sliding sections concealable into the center section. The interleaved sliding sections may be stacked over one another along a seating plane when the expandable seating furniture is unexpanded. One of the interleaved sliding sections, when expanded in a first direction, is supported by at least one of the lateral chair legs and at least one of the center chair legs. A second one of the interleaved sliding sections, when expanded in the first direction, may further be supported by at least two of the lateral chair legs, at least one of the at least two of the lateral chair legs being the at least one lateral chair supporting the first one of the interleaved sliding sections.

Optionally, the at least one lateral section comprises two or more interleaved sliding sections concealable into the center section and parallel slots may be provided between the center section and the interleaved sliding sections along a seating plane when the expandable seating furniture is unexpanded.

Optionally, the at least one lateral section comprises two or more interleaved sliding sections concealable into the center section and parallel slots and cooperating rods may be provided between the center section and the interleaved sliding sections along a seating plane when the expandable seating furniture is unexpanded.

At least some of the parallel slots may be juxtaposed next to one another. Additional parallel slots and cooperating rods may further be provided between the interleaved sliding sections along the seating plane. At least some of the parallel slots and cooperating rods may act together as rods for additional cooperating parallel slots along the seating plane.

A first one of the interleaved sliding sections may be expanded in a first direction and be supported by at least one of the lateral chair legs and at least one of the center chair legs. A second one of the interleaved sliding sections may be expanded in the first direction and be supported by at least two of the lateral chair legs, at least one of the at least two of the lateral chair legs being the at least one lateral chair supporting the first one of the interleaved sliding sections.

Optionally, the expandable seating furniture may comprise a corner section and the center section may be provided on a first lateral side of the corner section. The expandable furniture may yet further comprise a second center section provided on a second lateral side of the corner section and one or more second lateral sections, concealable into the second center section, each of the second lateral sections being laterally expandable for providing one or more second additional seating positions, wherein the second center section conceals one or more second lateral chair legs for each of the second lateral sections when the expandable seating furniture is unexpanded.

Optionally, the expandable seating furniture may also comprise one or more cushions for the one or more additional seating positions are concealable into the center section when the expandable seating furniture is unexpanded. The cushions may be non-structural cushions. At least one of the cushions may be concealable under the center section. At least one of the cushions may concealable in arm rests. The cushions may selectively be concealable in arm rests and under the center section.

Optionally, armrests of the lateral sections may further be concealed into armrests of the center section when the expandable seating furniture is unexpanded.

The present invention, in accordance with one or more embodiments, may provide one or more exemplary advantages. For instance, the expandable seating furniture, in an unexpanded configuration, may be provided to look like a normal (i.e., non-expandable) seating furniture. The expandable seating furniture may also be used like a normal seating furniture. It is possible to provide both non-expandable seating furniture and expandable seating furniture having identical, nearly identical or otherwise compatible design in order to fit different seating arrangements. The expandable seating furniture may be designed so that it doesn't look like a folding or stackable chair. The expandable seating furniture may be expanded in multiple seating positions, depending on instant needs. The expandable seating furniture may be provided with different mechanical designs to store the lateral supports. The expandable seating furniture may be customized, with different configurations: such as single direction, non-symmetrical (e.g., 3 left, one right or 2 right, one left, etc.). The expandable seating furniture may allow to keep the cushions (or seating surface) at the same level in fully-expanded and/or partially-expanded configuration(s). The expandable seating furniture may be easier to ship given a more efficient space usage (e.g., instead of shipping a sofa, one can ship a chair that expands into a sofa at destination or when needed). The expandable seating furniture provides different design options:

- simple: with resin covered support for outdoor furniture;
- modern: simple bars, painted, chromed or stainless steel; with or without armrests;
- waiting room: metallic, plastic cushions, wear resistant, thin cushions (or base) to allow for more expandable seats and/or stacking;
- living room: leather cushions, comfortable, limited space in retracted configuration (e.g., in two places love seat, three or more places sofa for guests or as a bed; corner model with two places, that can expand, etc.);
- balcony: space saving solution;
- concealable cushions (e.g., under the seat, or in the arm rests); and/or
- different materials: plastic, metal, wood etc.

The expandable seating furniture may offer a seating solution that takes a limited space when not needed and is transformable into a full sofa with multiple places, e.g., for your guests. Yet, the expandable seating furniture may be retracted when more space is needed.

BRIEF DESCRIPTION OF THE DRAWINGS

Further features and exemplary advantages of the present invention will become apparent from the following detailed description, taken in conjunction with the appended drawings, in which.

DETAILED DESCRIPTION

The present invention relates to an expandable seating furniture (e.g., chair or bench), which can be expanded or retracted from one or more places to multiple places (or sitting positions), e.g., for space saving purpose. The present invention applies to seating furniture comprising benches as well as chairs, which terms are often used interchangeably in the following discussion. Skilled persons will readily recognize that features related to a back support portion of the chair are absent from the bench. However, unless explicitly identified, the teachings of the present invention are applicable to both benches and chairs. For instance, the chair and the bench both include a center support that consists in a base and the chair also comprises a back support. In some embodiments, the base and the back support (whenever applicable) have interworking slots (e.g., square, round or of different shapes) that allow for lateral supports to slide in or out. The seating furniture can therefore provide a varying number of sitting positions between an unexpanded configuration having an unexpanded capacity of 1 or more places to a partially expanded configuration or fully expanded configuration having an expanded capacity greater than the unexpanded capacity. For instance, the expandable functionality may be useful for more efficient storage of temporary seating furniture (e.g., in a multi-purpose room) as the unexpanded and, if applicable, partially expanded configurations take less storage space. Likewise, the expandable functionality may also be useful to provide additional temporary seating places (e.g., in smaller rooms). It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention as claimed.

Figure 1:
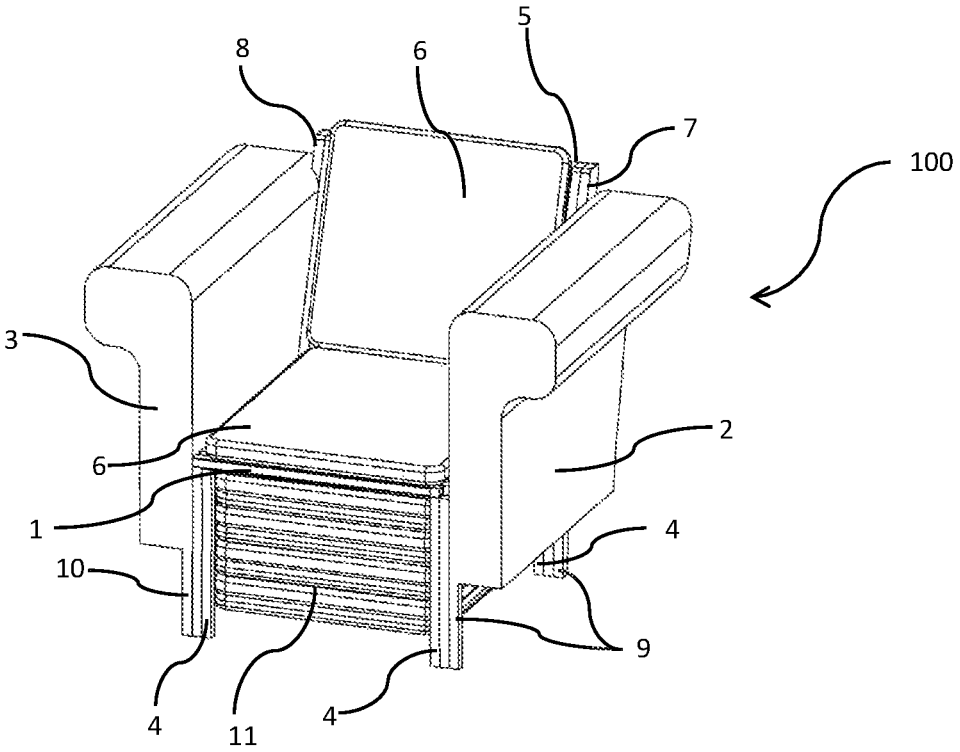
FIG. 1 is perspective view of an exemplary chair in an unexpanded one-place configuration in accordance with an embodiment of the present invention.

Reference is now made concurrently to FIG. 1 to FIG. 8 of the drawings, show perspective views of an exemplary expandable seating furniture depicted as a chair 100. In FIG. 1, the chair 100 is shown in a first unexpanded configuration, which may also be referred to as a closed position. As indicated above, the unexpanded configuration provides a seating furniture that may be used a normal (i.e., non-expandable) chair when in closed position. The expandable chair 100 provides space saving by concealing one or more additional seating positions inside the center section 1. As depicted in FIG. 1, the center section 1 provides a first seating position and also conceals, in the example of FIG. 1 to FIG. 8, two left lateral sections 2 and two right lateral sections 3. The center section 1 has legs 4, a back support 5 and supports a cushion 6. Each of the left lateral sections 2 provide back support 7 and legs 9 (comprising 9*a* and 9*b*) with each of the right lateral sections having back support 8 and legs 10 (comprising 10*a* and 10*b*). Additional cushions 11 for the lateral sections 2 and 3 are concealable inside the center section 1 as depicted. When not in use, the lateral sections 2 and 3 and corresponding ones of the cushions 11 remain concealed inside the center section. When needed, one or more of the lateral sections 2 and 3 can be expanded and relevant ones from the cushions 11 can be used accordingly. Skilled person will have understood that a simpler version (not shown) of the chair 100 may consist of a bench without the back support 5, 7 or 8 or a hybrid between a bench and a chair with the one or more of the back supports 5, 7 and 8 being provided (e.g., only 5 is provided, only 5 and 7 are provided or only 7 and 8 are provided leaving two distant seating positions having a bench (which could yet further be used as table) positioned in between). The exemplary embodiment of FIG. 1 depicts the expandable chair 100 configured to have a single center section 1 and four (4) lateral sections 2 and 3. Skilled persons will readily recognize that other configurations may be provided with different number of lateral sections 2 and/or 3, with only left 2 or right 3 lateral sections or with an asymmetrical number of lateral sections. Likewise, the center section 1 may provide more than one seating position and one or corresponding lateral sections may therefore also selectively provide 1 to many additional seating positions. For instance, a two-place center section may be expanded laterally with a single lateral section to provide a three-place configuration or, when the single lateral section is further expanded, a four-place configuration.

Figure 2:
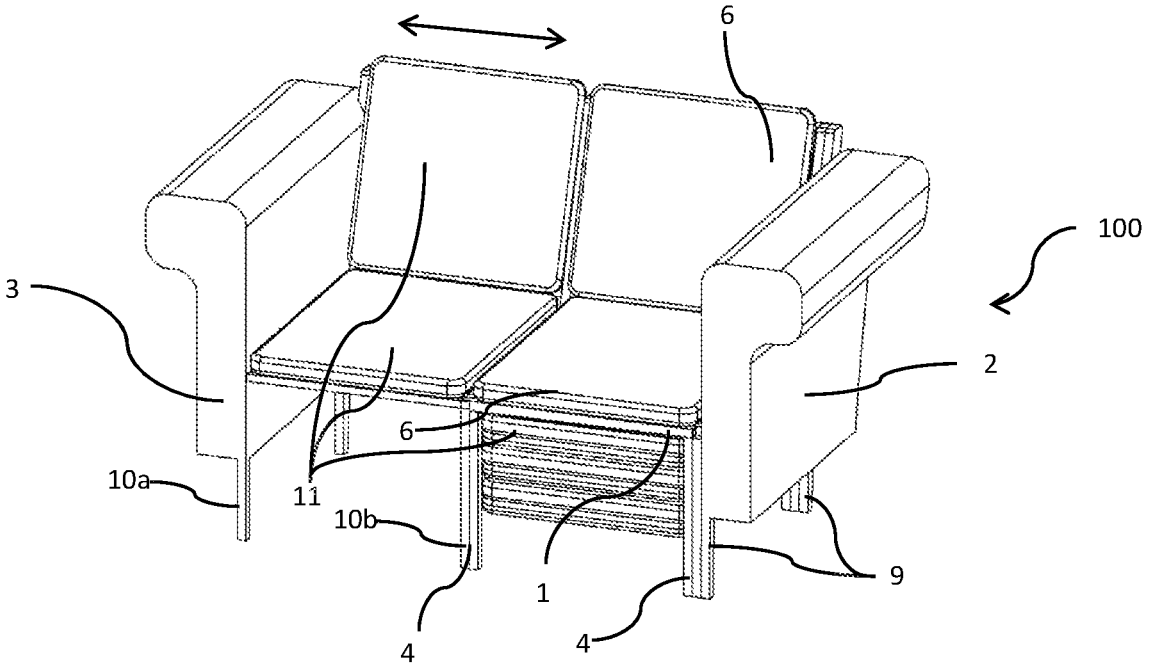
FIG. 2 is perspective view of the exemplary chair of FIG. 1 in a partially-expanded (two-place) configuration.

As illustrated in FIG. 2, the expandable chair 100, is shown here with the center section 1 and one of the lateral section 3 expanded into a second seating position to the right. Two (2) of the cushions 11 concealed initially inside the center section 1 are positioned to cover the second seating position, which is provided, at the same level along a seating plane compared to the seating first position provided by the center section 1. The expandable chair 100 depicted in FIG. 2 has now 2 full seating positions, which may advantageously be provided within in a few seconds in accordance with selected embodiments.

Figure 3:
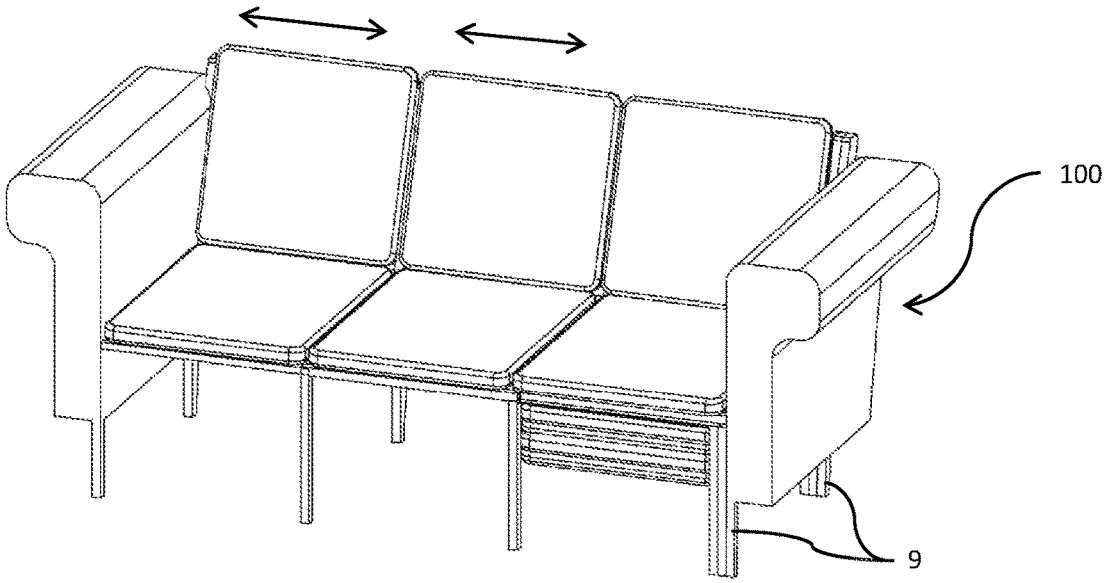
FIG. 3 is perspective view of the exemplary chair of FIG. 1 in a partially-expanded (three-place) configuration.
Figure 4:
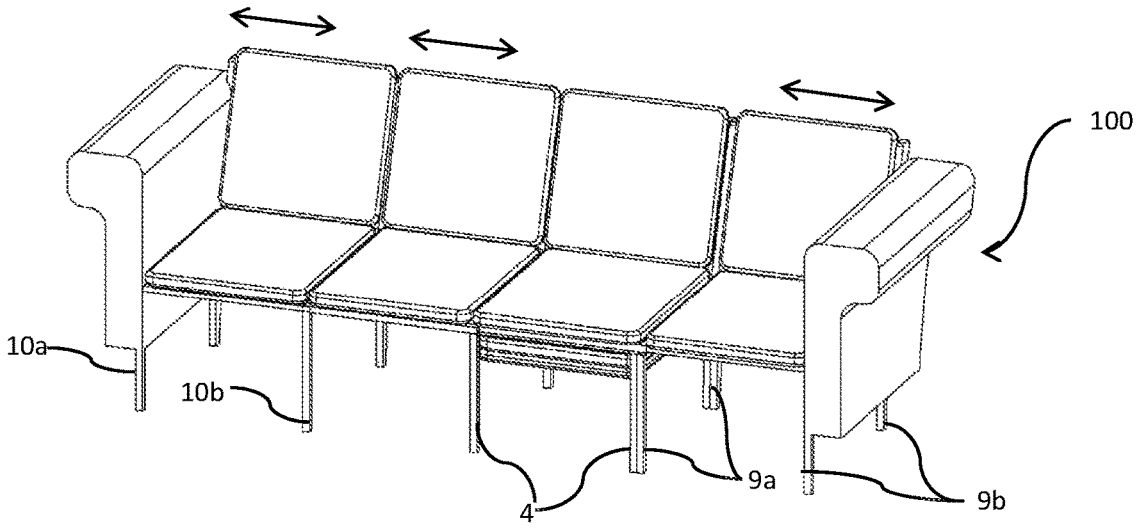
FIG. 4 is perspective view of the exemplary chair of FIG. 1 in a partially-expanded (four-place) configuration.
Figure 5:
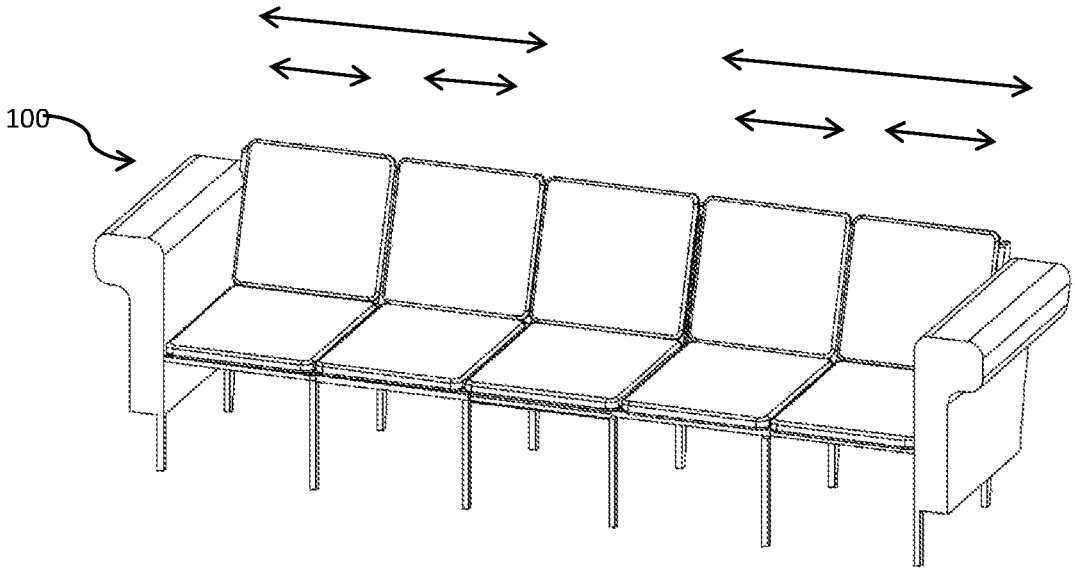
FIG. 5 is perspective view of the exemplary chair of FIG. 1 in a fully-expanded (five-place) configuration.

As illustrated in FIGS. 3, 4 and 5, the expandable chair 100 can now be expanded in the same way as shown in FIG. 2 into 3, 4 or 5 seating positions, expanding the lateral sections 2 and 3 and using the cushions 11 to create these additional seating position(s). The lateral sections 2 and 3 were previously concealed inside the center section 1 and not visible. The chair 100 initially configured for one (1) person in an unexpanded configuration can accommodate up to 5 persons depending on selected expanded or partially expanded configuration selected. The chair 100 can be closed correspondingly, e.g., by retracting (closing) the lateral sections 2 and 3 for concealing inside the center section 1 and storing (concealing) the lateral cushions 11 back inside or under the center section 1.

Figure 6:
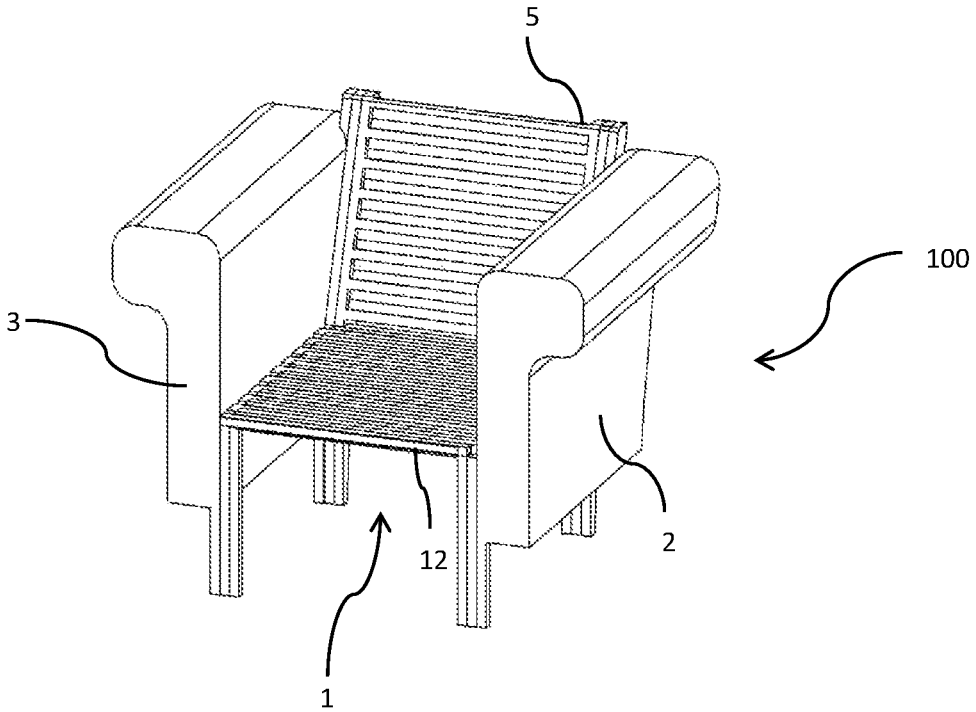
FIG. 6 is perspective view of the exemplary chair of FIG. 1 in the un-expanded configuration without cushions.

In one embodiment shown in FIG. 6, the center section 1 has a frame 12 and back support 5 configured with cooperating mechanical connections to guide, support and/or conceal the lateral sections 2 and 3. For instance, different slots or channels and cooperating rods or tubes may be provided in both the frame 12 and the back support 5. Additional, channels, sliders or other type of mechanical connections may also be used. In some embodiments, the cushions 11 are non-structural elements and the mechanical connections support the cushions 11 for providing the center seating position and the additional seating position(s). Every one of the seating positions may be provided at a single level along the seating plane (as depicted in FIG. 1 to FIG. 8). In other embodiments, the seating positions may be provided at different levels.

Figure 7:
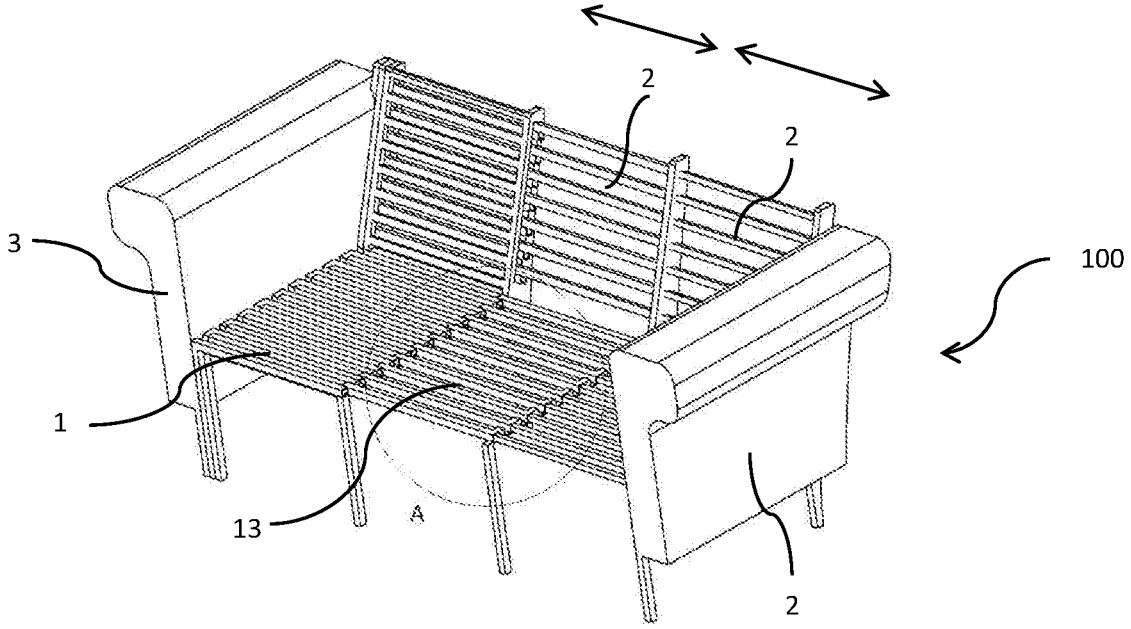
FIG. 7 is perspective view of the exemplary chair of FIG. 6 in a partially-expanded (three-place) configuration.
Figure 8:
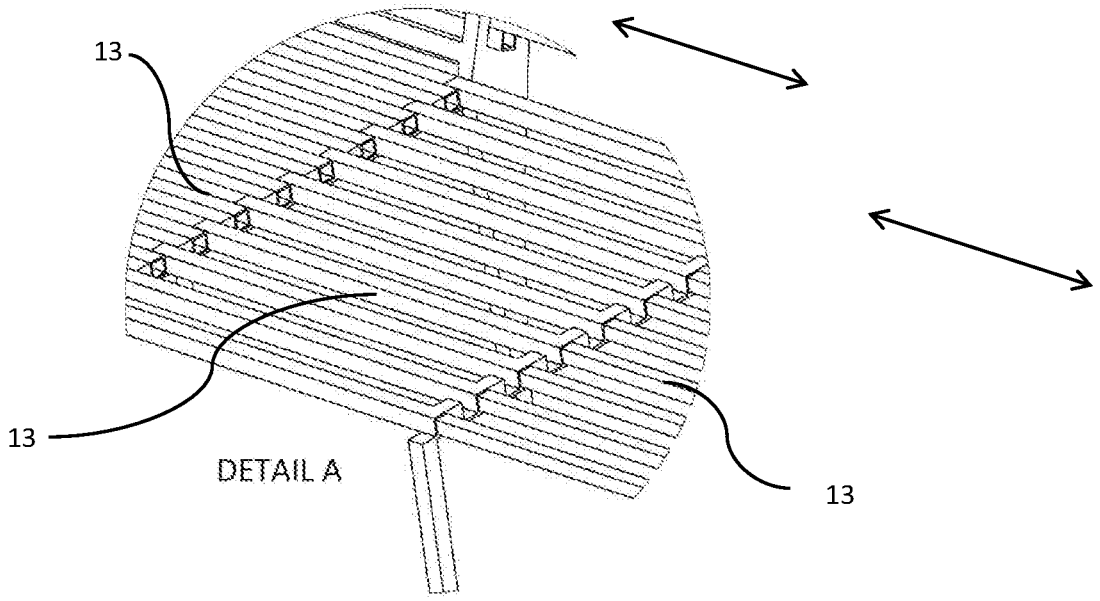
FIG. 8 is a detailed view of a portion of the chair depicted on FIG. 7.
Figure 9:
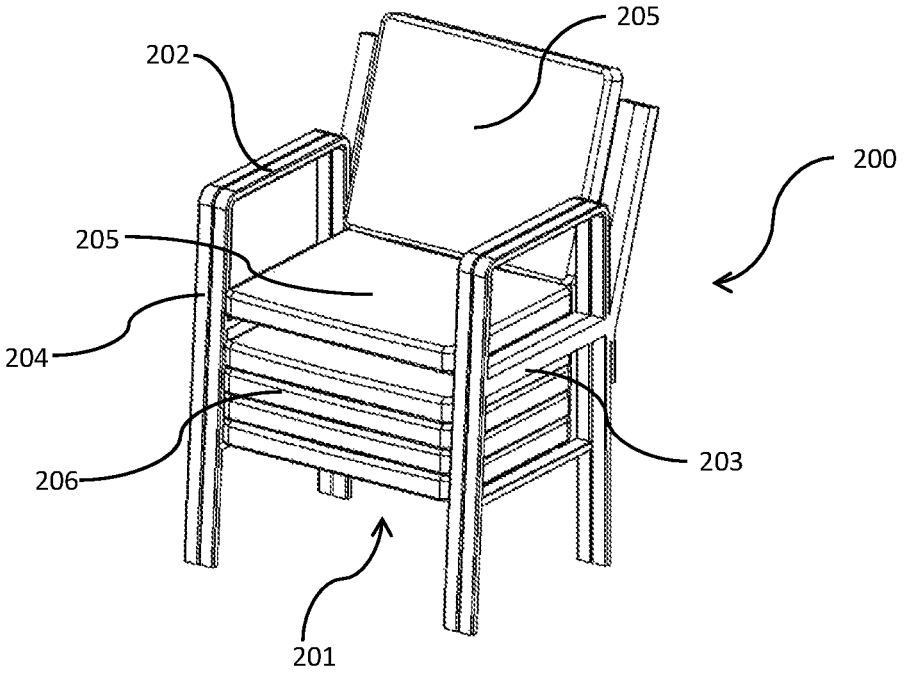
FIG. 9 is a perspective view of an exemplary chair in an un-expanded configuration.

With particular reference to FIG. 7 and FIG. 8, the expandable chair 100 is depicted with the center section 1 and the two (2) lateral left sections 2 being expanded, the cushions 11 being left out for clarity. In the depicted embodiments, square sliding telescopic tubes 13 are provided to conceal and then create new positions when extracted. The square sliding telescopic tubes 13 are sliding inside one another to be concealed in the unexpanded position inside the central section 1 and may be expanded (extracted, telescopically) to create the one or more additional lateral seating positions.

Reference is now made concurrently to FIG. 9 to FIG. 15, which show perspective views of an exemplary expandable chair 200 in accordance with embodiments of the present invention. A center section 201 is provided and may be used as a normal (e.g., non-expandable) chair, with or without armrests 202. Skilled person will readily acknowledge that the armrest 202 may be configured in multiple ways, as needed, without affecting the teachings of the present invention. For instance, the armrests 202 may comprise only two armrests at extremities (not shown) such that, when extended, there are no armrests at interior positions, each seating positions may be provided with armrests (as exemplified) or no armrest at all may be provided (not shown). In the example of FIG. 9 to FIG. 15, the chair 200 is provided with a left lateral section 203 and a right lateral section 204 stored (e.g., concealed or hidden) inside the center section 201. The chair 200 may be provided in different configurations with, for instance, as two expandable sections on the left and none on the right; or three expandable sections on the right and one on the left, etc. The center section 201 is provided with cushions 205 providing at least some structural support for a first seating position. Additional cushions 206 for one or more of the lateral sections are stored (concealed, hidden) inside the center section 201 when in the unexpanded configuration.

Figure 10:
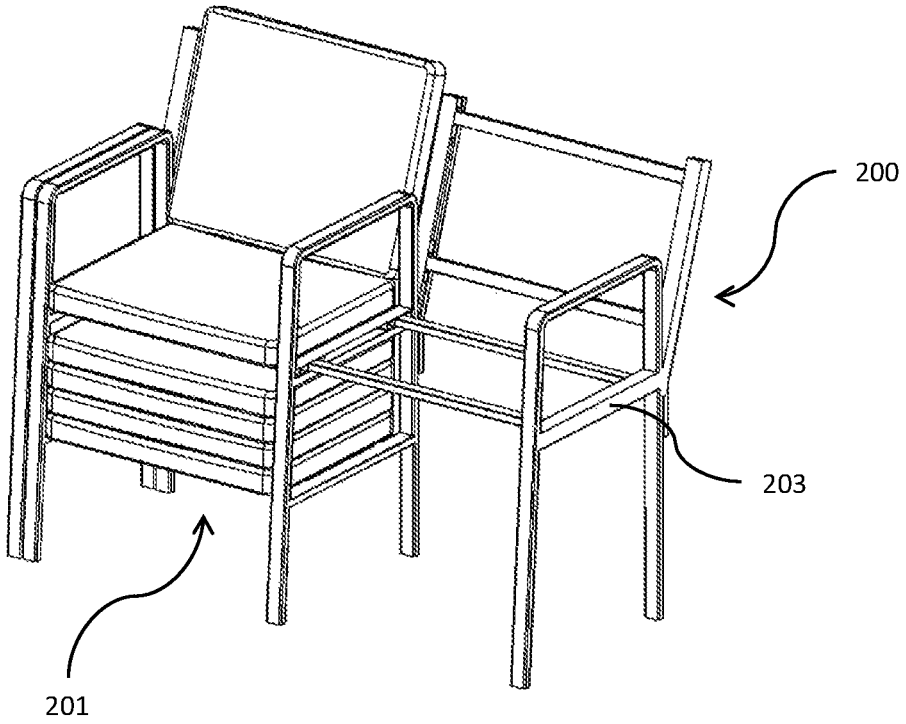
FIG. 10 is a perspective view of the exemplary chair of FIG. 9 in a partially-expanded (two-place) configuration partially covered with cushions.

FIG. 10 better shows the chair 200 with the center section 201 and left lateral section 203 in a partially-expanded configuration. The cushions 206 are not shown over the left lateral section 203, for clarity. In the depicted example, the lateral section 203 is pulled from the center section 201, e.g., with tubes 207 sliding out to create a support for the cushions 206, which provide create an additional lateral seating position.

Figure 11:
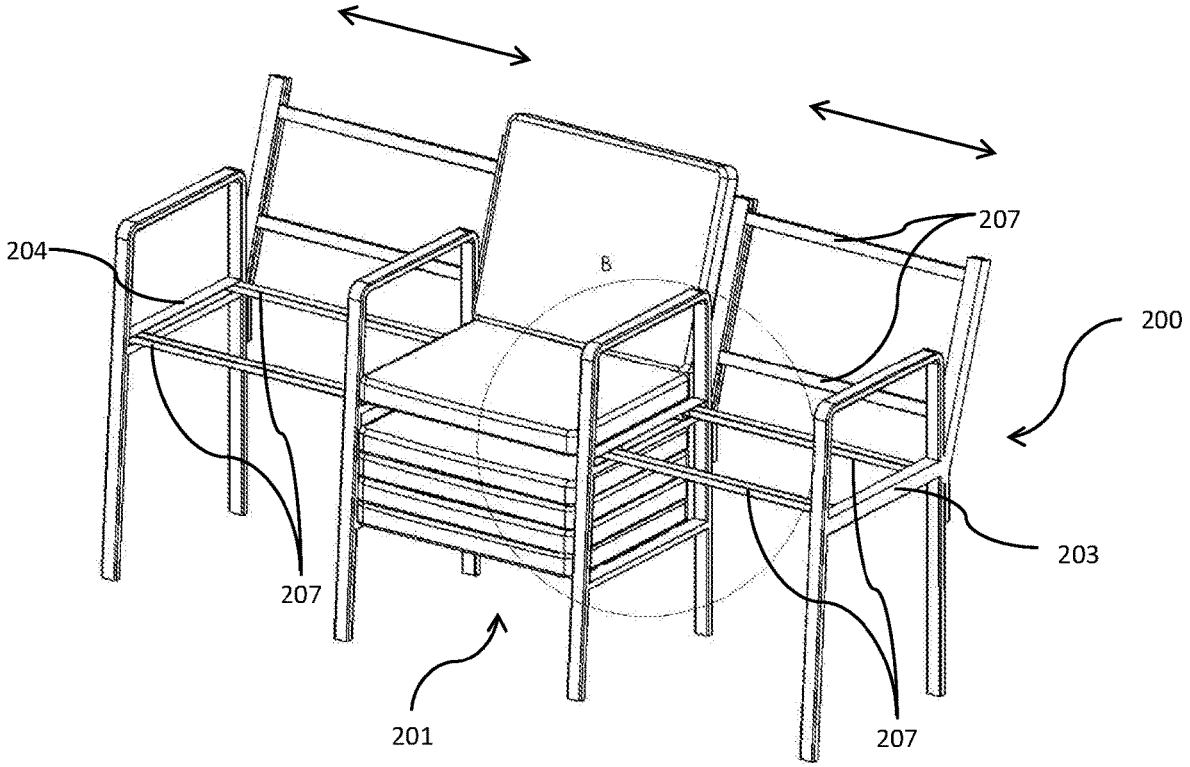
FIG. 11 is a perspective view of the chair of FIG. 9 in a fully-expanded (three-place) configuration partially covered with cushions.
Figure 12:
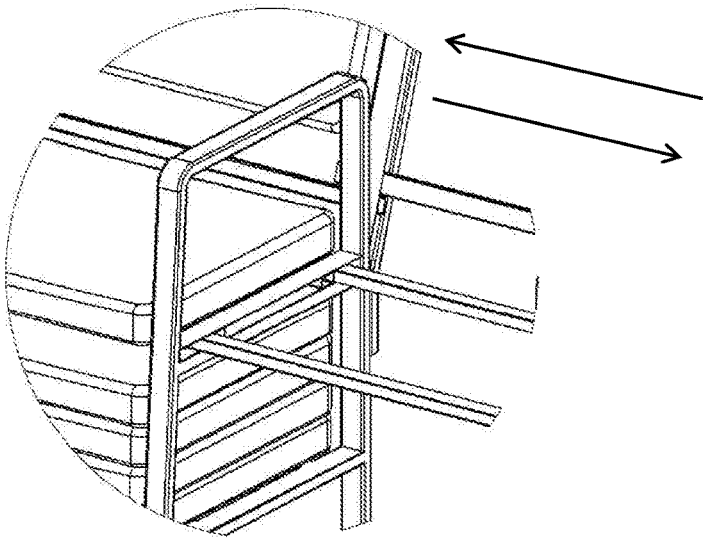
FIG. 12 is a detailed view of a portion of the chair depicted in FIG. 11.

FIG. 11 depicts the chair 200 with the center section 201, the left lateral section 203 and the right lateral section 204 in a fully-expanded configuration. Tubes 207 are expanded, as better seen in on FIG. 12. Skilled persons will readily recognize that the tubes 207 only provide one example of the different slots, shapes, rods, channels and sliding mechanisms that may be provided with or without bearings. The tubes 207 may further be interlaced (not shown), having different distances between them to allow a good support for the cushions 206 when these are non-structural cushions. The number of supports can vary for the base of the seat and the back support. The tubes 207 can keep the cushions or other seating supports at a single seating plane level or different levels.

Figure 13:
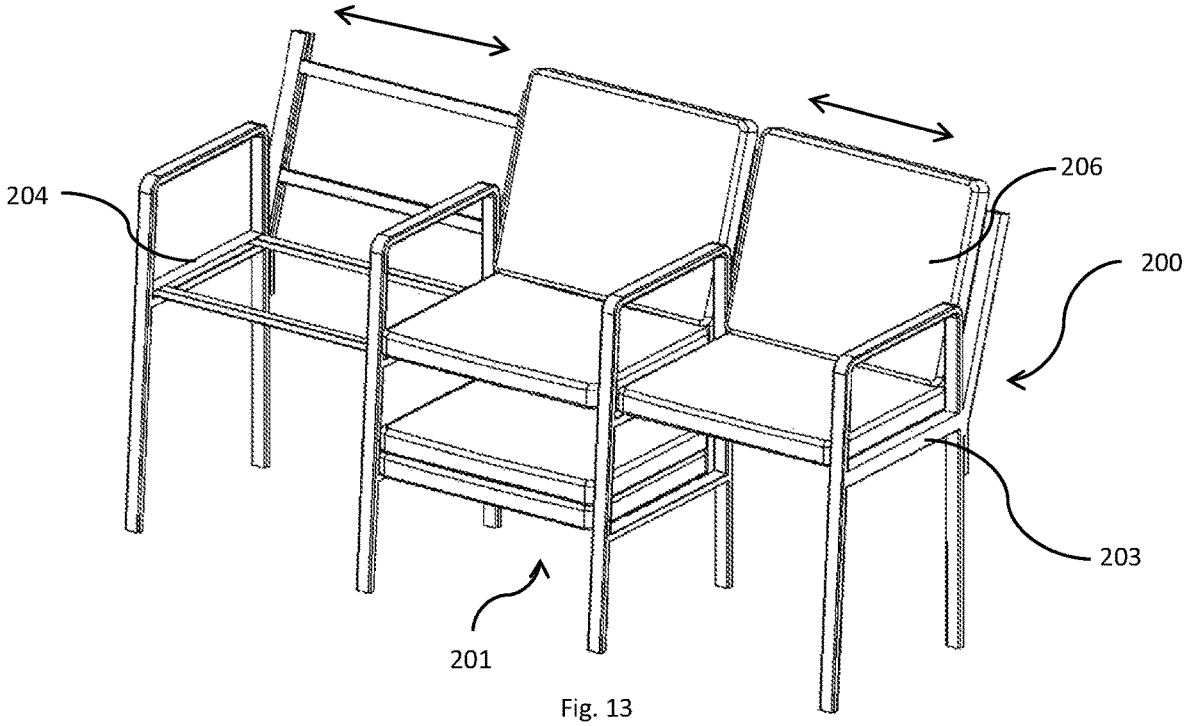
FIG. 13 is a perspective view of the exemplary chair of FIG. 9 in a fully-expanded (three-place) configuration partially covered with cushions.
Figure 14:
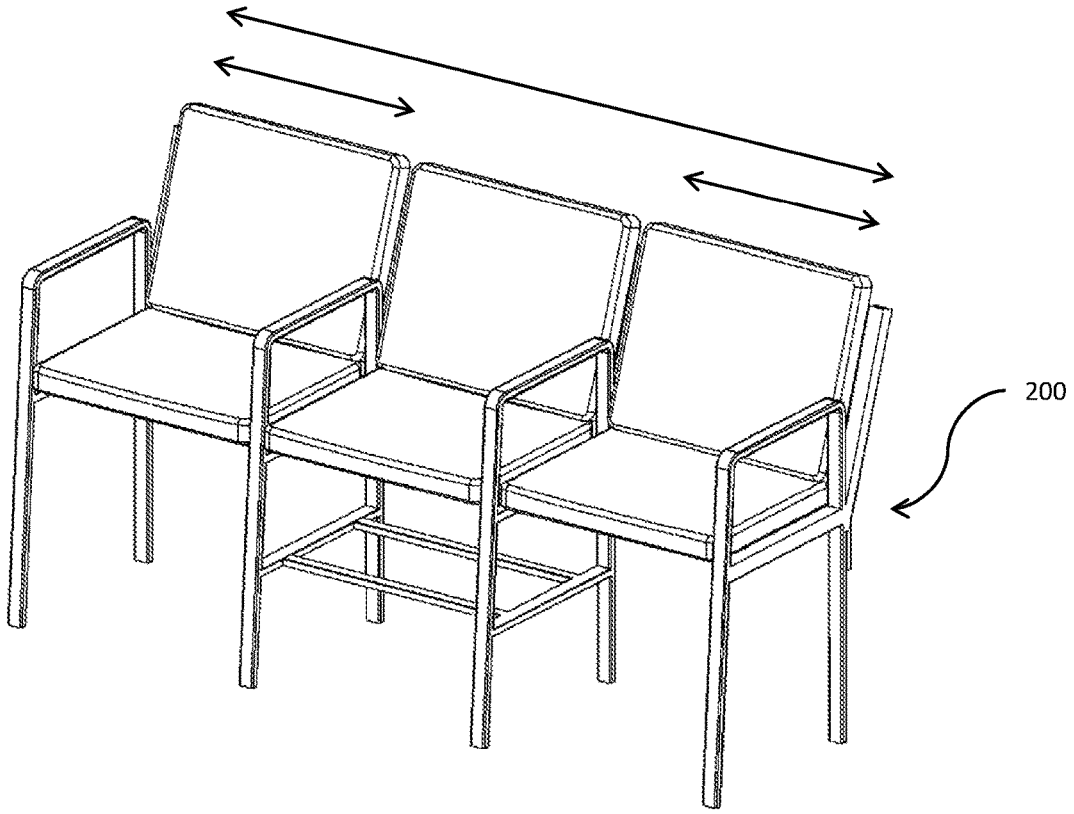
FIG. 14 is a perspective view of the exemplary chair of FIG. 9 in the fully expanded (three-place) configuration with cushions.
Figure 15:
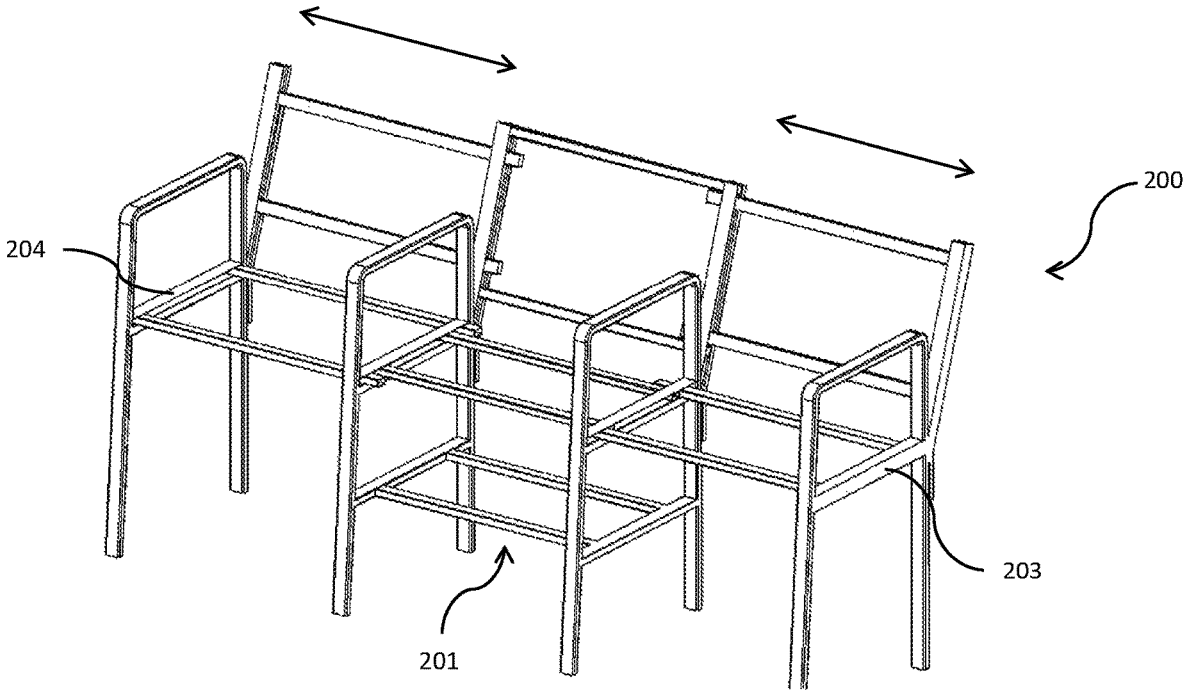
FIG. 15 is a perspective view of the exemplary chair of FIG. 9 in a fully expanded (three-place) configuration without cushions.

FIG. 13 and FIG. 14 show the expandable chair 200 with the center section 201, lateral sections 203 and 204 expanded and left lateral section 203 with different cushion configurations. FIG. 15 shows the expandable chair 200 without any cushion for the center section 201 and lateral sections 203 and 204. The chair 200 may be provided with different configuration of center section, different numbers of center and/or lateral sections, as generally discussed with reference to the example of FIG. 1 to FIG. 8. Skilled persons will understand that multiple configurations may be provided with different number of center sections, different number of lateral sections on left and/or right. The lateral sections tubes may be provided in different numbers, shapes and positions, in a way that allows them to be stored inside the center section(s) and be expanded when needed. The example of FIG. 9 to FIG. 15 may be used in many other configurations, e.g., shown with reference to the examples of FIG. 1 to FIG. 8.

Figure 16:
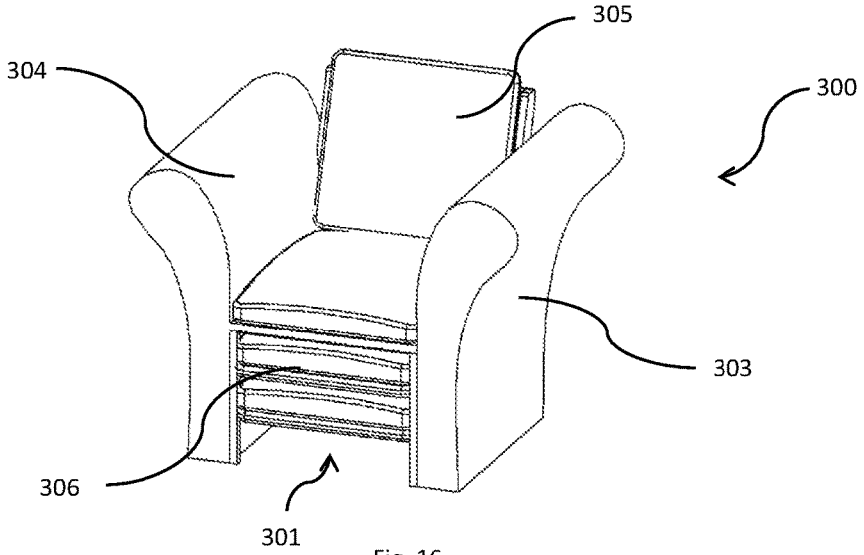
FIG. 16 is a perspective view of an exemplary chair with upholstered armrests in an unexpanded (one-place) configuration.
Figure 17:
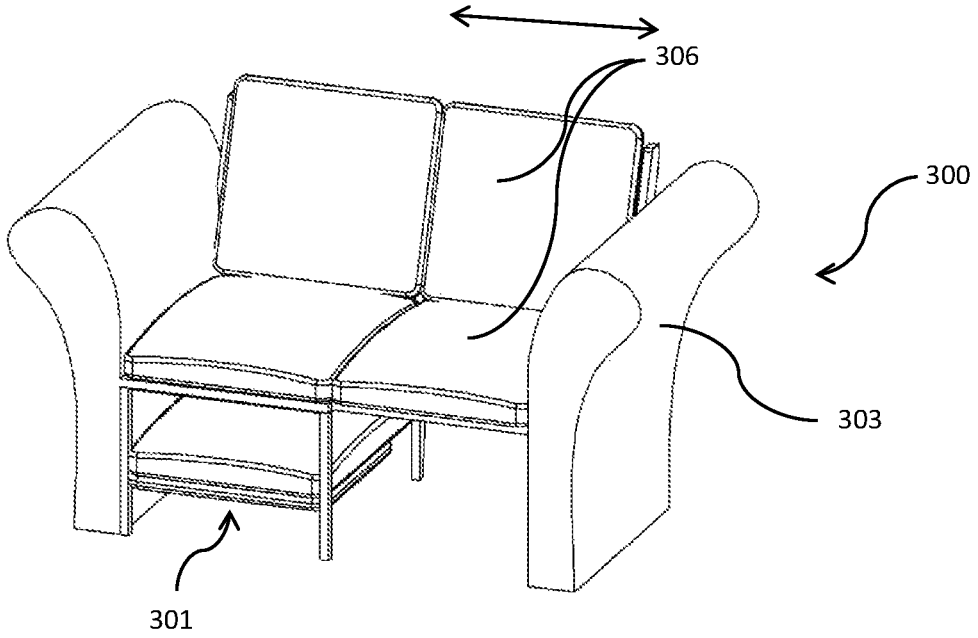
FIG. 17 is a perspective view of the exemplary chair of FIG. 16 with upholstered armrests in a partially-expanded (two-place or love-seat) configuration.
Figure 18:
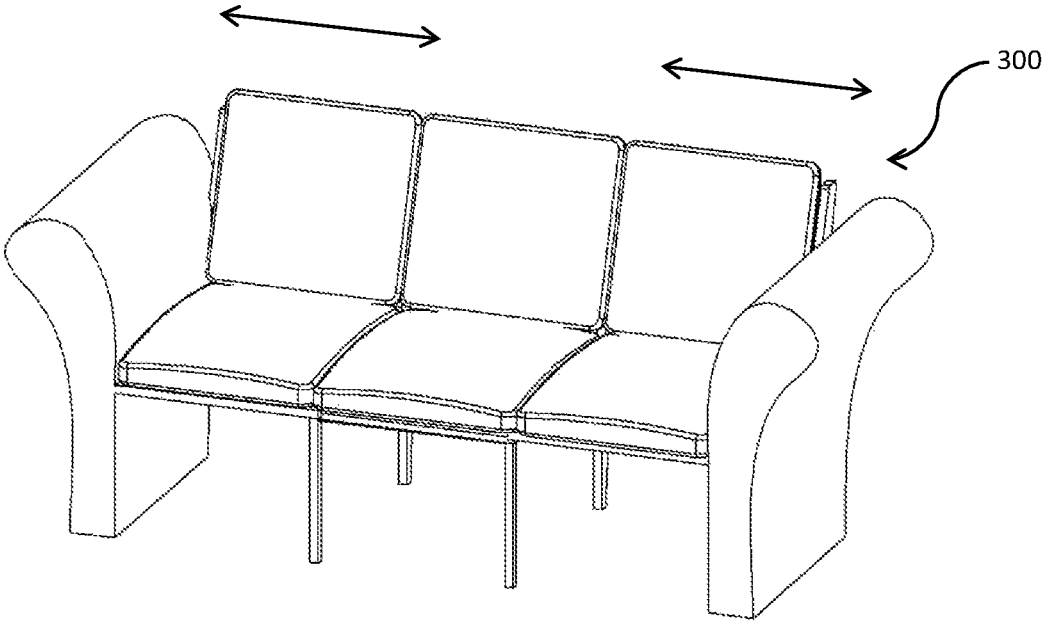
FIG. 18 is a perspective view of the exemplary chair of FIG. 16 with upholstered armrests in a fully-expanded (three-place or sofa) configuration.
Figure 19:
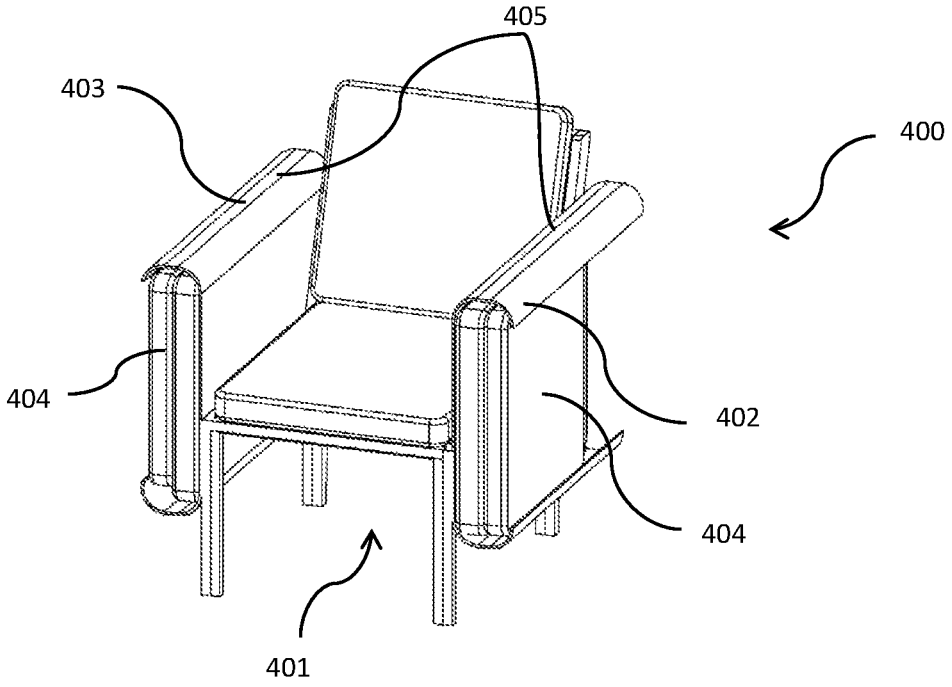
FIG. 19 is a perspective view of an exemplary chair with concealing armrests in an unexpanded (one-place) configuration.

Reference is now made concurrently to FIG. 16 to FIG. 18, which show perspective views of an exemplary expandable chair 300 in accordance with embodiments of the present invention. The expandable chair 300 is upholstered. The chair 300 may be provided in different materials (textile, leather, etc.), may have different number of central 301 or lateral sections 303, 304 and be provided with or without armrests. The chair 300 may be used as a normal (i.e., non-expandable) chair (or armchair) and expanded laterally as shown above, depending on required configuration made and needs. For instance, the chair may be expanded to provide two (2) seating positions (loveseat) as shown in FIG. 17 or three (3) seating positions (a full sofa) as shown in FIG. 18, or even more seating positions so configured.

FIG. 17 shows the expandable chair 300 with center section 301 and left lateral section 303 expanded into a two place partially expanded configuration (loveseat) with cushions 306. Additional cushions 306 for the right lateral section may be stored or concealed under the center section 301. FIG. 18 shows the expandable chair 300 with center section 301 and both lateral sections expanded into a three-place sofa in a fully expanded configuration. Cushions 306 previously stored inside the center section 301 are now positioned on the lateral sections 303 and 304 in order to provide the additional seating positions with base and back. The example of FIG. 16 to FIG. 18 may be used in many other configurations, e.g., shown with reference to the examples of FIG. 1 to FIG. 15.

Figure 20:
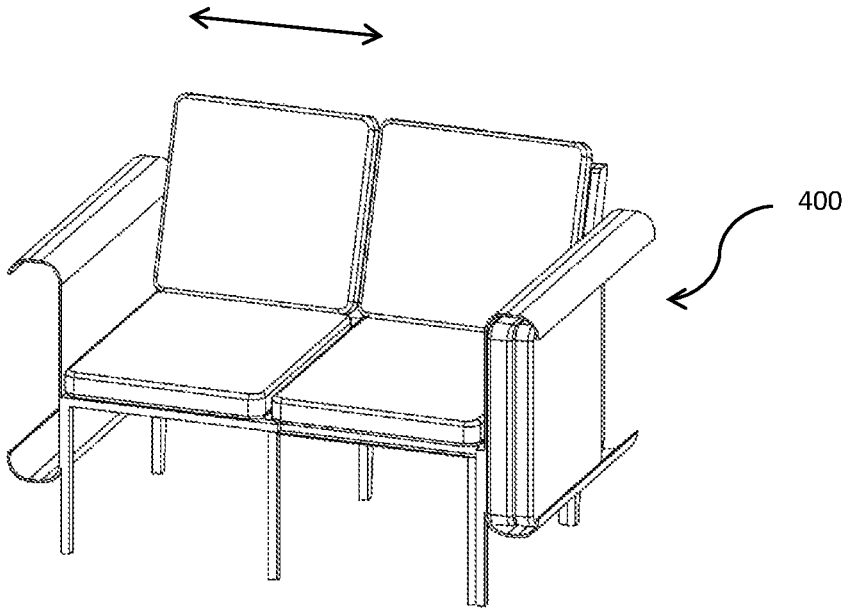
FIG. 20 is a perspective view of the exemplary chair of FIG. 19 with concealing armrests in a partially-expanded (two-place) configuration.
Figure 21:
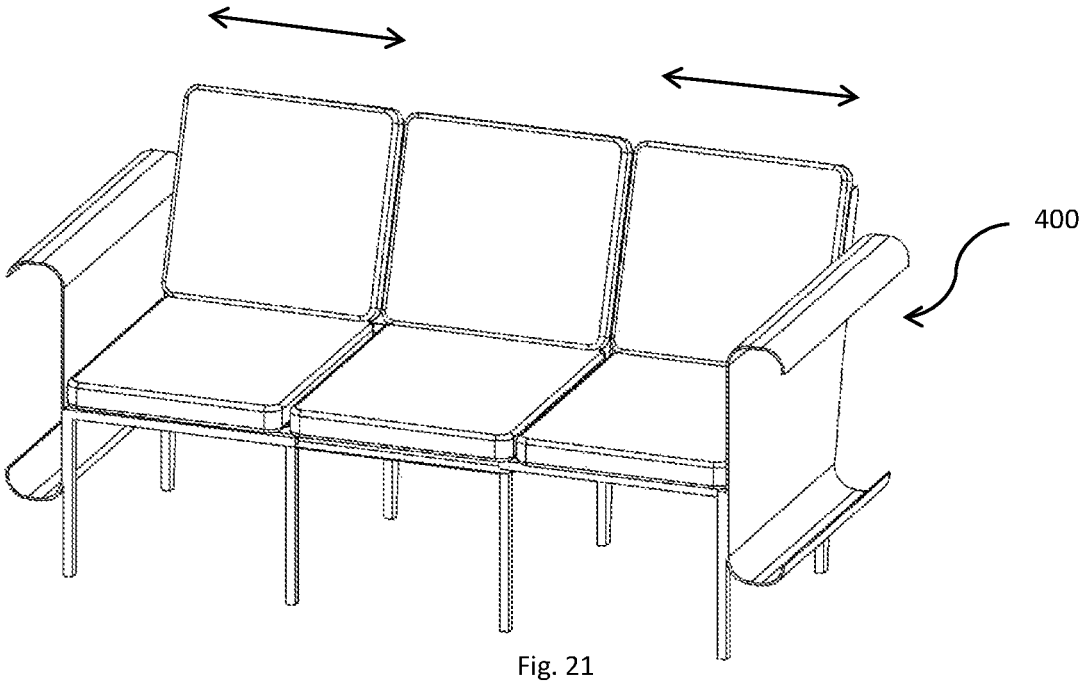
FIG. 21 is a perspective view of the exemplary chair of FIG. 19 with concealing armrests in a fully-expanded (three-place) configuration.
Figure 22:
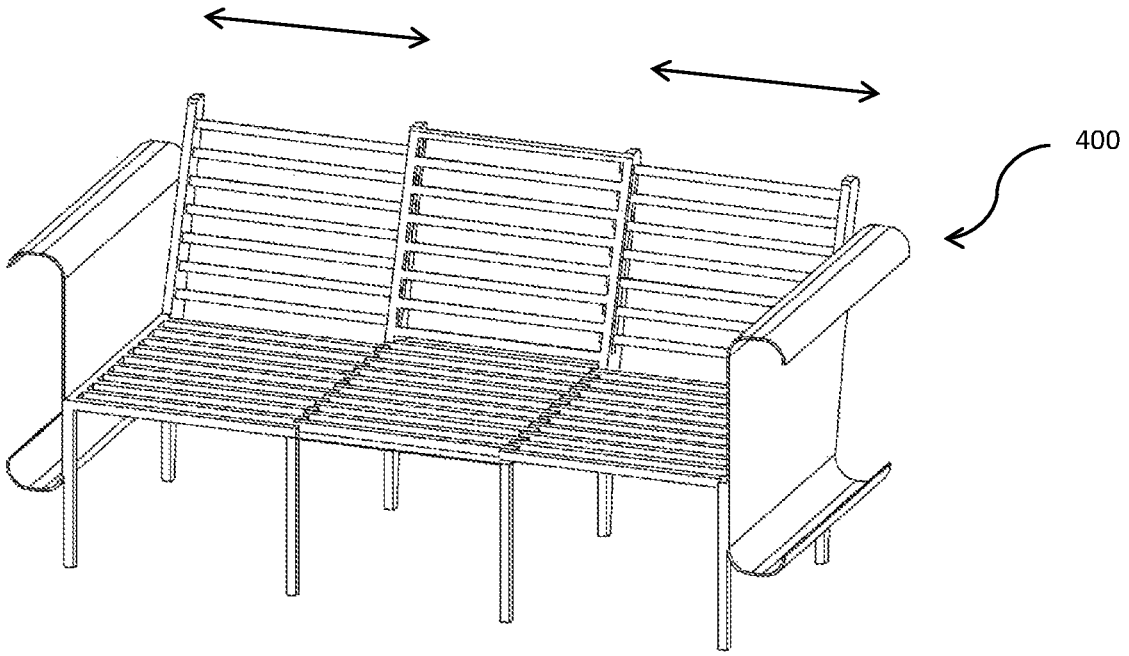
FIG. 22 is a perspective view of the exemplary chair of FIG. 19 with concealing armrests in a partially-expanded (two-place or love-seat) configuration without cushions.

Reference is now made concurrently to FIG. 19 to FIG. 22, which show perspective views of an exemplary expandable chair 400 having a center section 401 that conceals lateral sections 402 and 403. The lateral section 402 and 403 may be expanded to provide additional seating position(s) as depicted in FIG. 20 and FIG. 21. Cushions 404 for the additional seating positions may be stored (concealed, hidden) inside armrests 405 of the chair 400. Different designs of the armrests 405 may be provided to hide more or less the cushions 404, and can provide storage space for more seating positions if needed. FIG. 20 shows the expandable chair 400 with center section 401 and the right lateral section 404 now expanded from the center section 401 into a partially expanded configuration. FIG. 21 shows the expandable chair 400 expanded to have three (3) seating positions, from a single initial position, into a fully expanded configuration. A top surface of the cushions 404 may be at the same level or at different levels even underlying support may be provided at different levels. Different cushions (not shown) may be used depending of the design, thicker for comfort, thinner to create more positions, FIG. 22 shows the expandable chair 400 without any cushions, with the lateral sections 402 and 403 expanded to provide the additional seating positions. Multiple solutions and configurations mentioned above with reference to other exemplary chairs 1, 200 and 300 may further be used to provide the additional sections, such as tubes of different shape and numbers, rods, bars, sliders with or without bearings, etc. The center section 401 thus provides support for interlaced, parallel, telescopic or any other solution for the cushions and/or plates that form the base and the back of the seats. The example of FIG. 16 to FIG. 22 may be used in many other configurations, e.g., shown with reference to the examples of FIG. 1 to FIG. 15.

Figure 23:
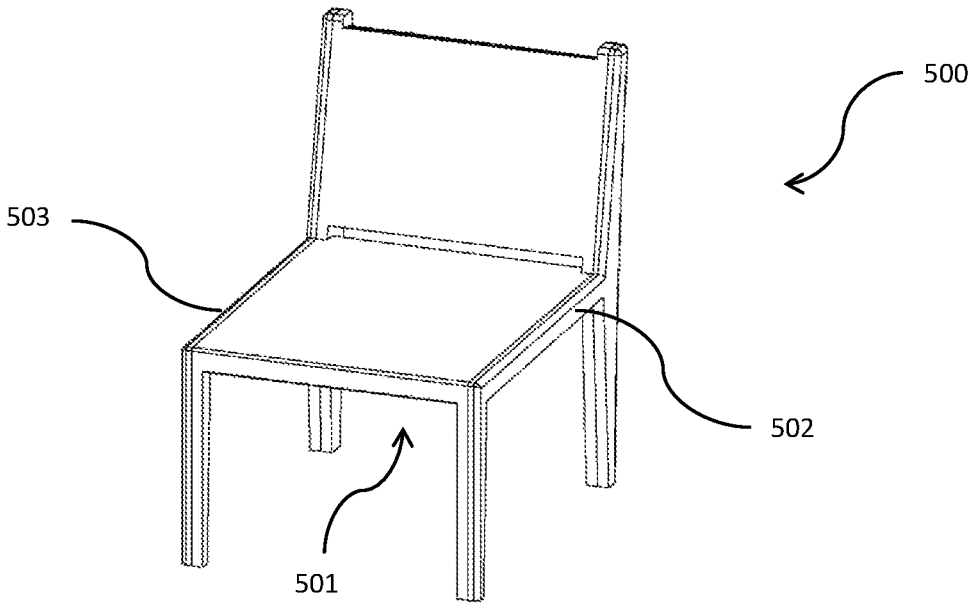
FIG. 23 is a perspective view of a cushion-free exemplary chair in an unexpanded configuration.
Figure 24:
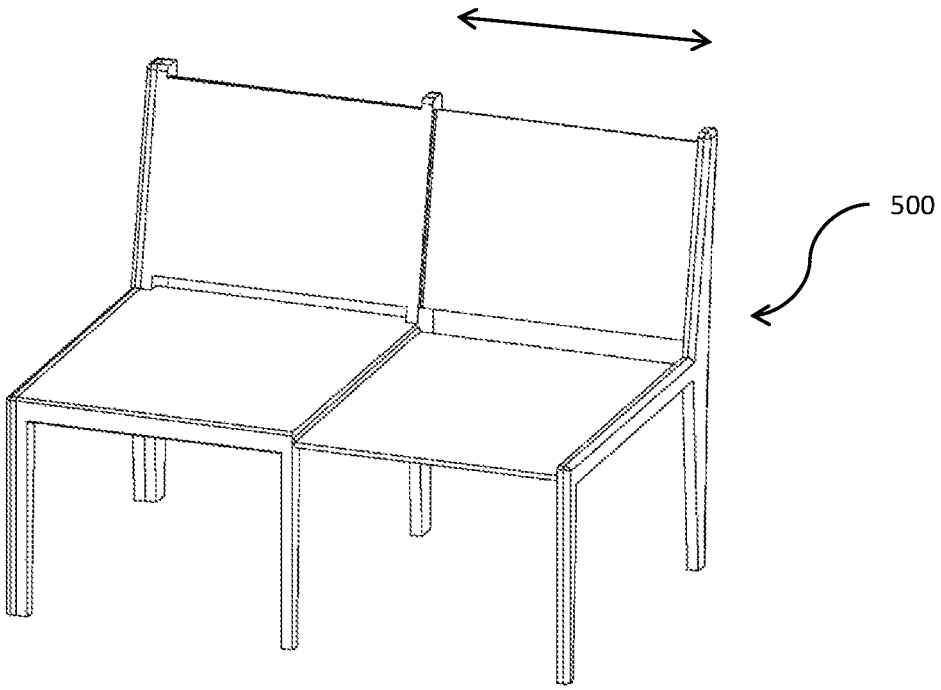
FIG. 24 is a perspective view of the cushion-free exemplary chair of FIG. 23 in a partially expanded (two-place) configuration.
Figure 25:
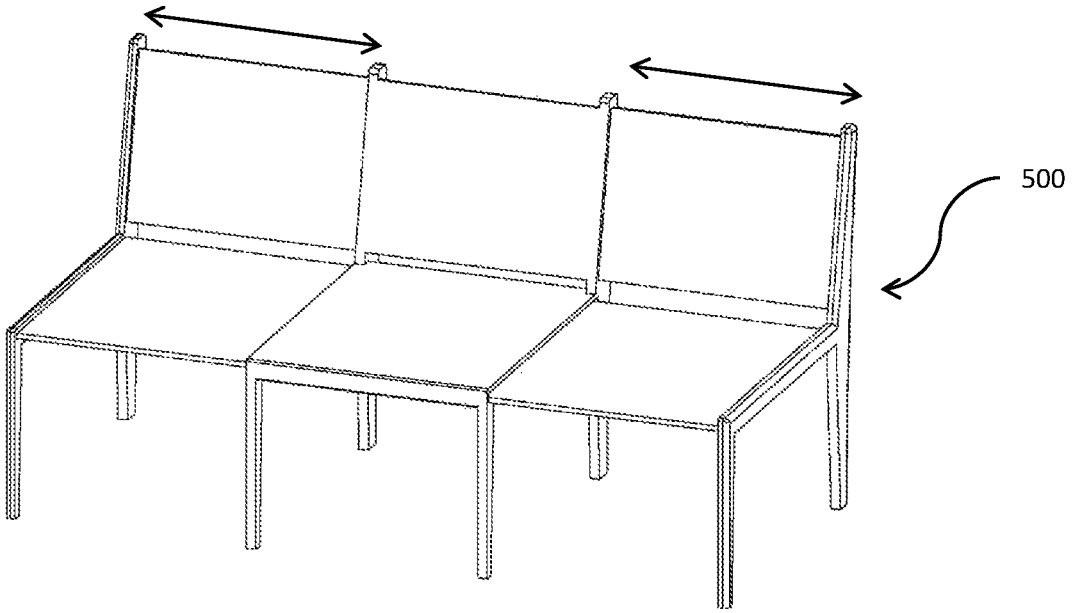
FIG. 25 is a perspective view of the cushion-free exemplary chair of FIG. 23 in a fully expanded (three-place) configuration.

Reference is now made concurrently to FIG. 23 to FIG. 25, which show perspective views of an exemplary expandable chair 500 depicted on FIG. 23 in retracted position or unexpanded configuration. The chair 500 may be made from wood, steel, plastic and/or other materials. The chair 500 looks like a regular (i.e., non-expandable) chair and conceals within a center section 501 one or more lateral sections 502 and 503. The lateral sections 502 and 503 may be expanded laterally when needed. FIG. 24 presents the expandable chair 500 with the center section 501 and the left lateral section 502 expanded in a partially expanded configuration. The shape of the base and the back of the seat can be a simple plate or a more complex shape for comfort, in one-piece or in multiple pieces assembling, soldering or otherwise appropriately maintained together. The chair 500 may be provided with or without cushions and/or with or without armrests. FIG. 25 shows the expandable chair 500 with the center section 501 and lateral sections 502 and 503 expanded into a fully-expanded configuration. In the fully-expanded configuration, the chair 500 provided three seating positions. Skilled persons will readily understand that different number of lateral sections, as needed, per design. The example of FIG. 23 to FIG. 25 may be used in many other configurations, e.g., shown with reference to the examples of FIG. 1 to FIG. 22.

Figure 26:
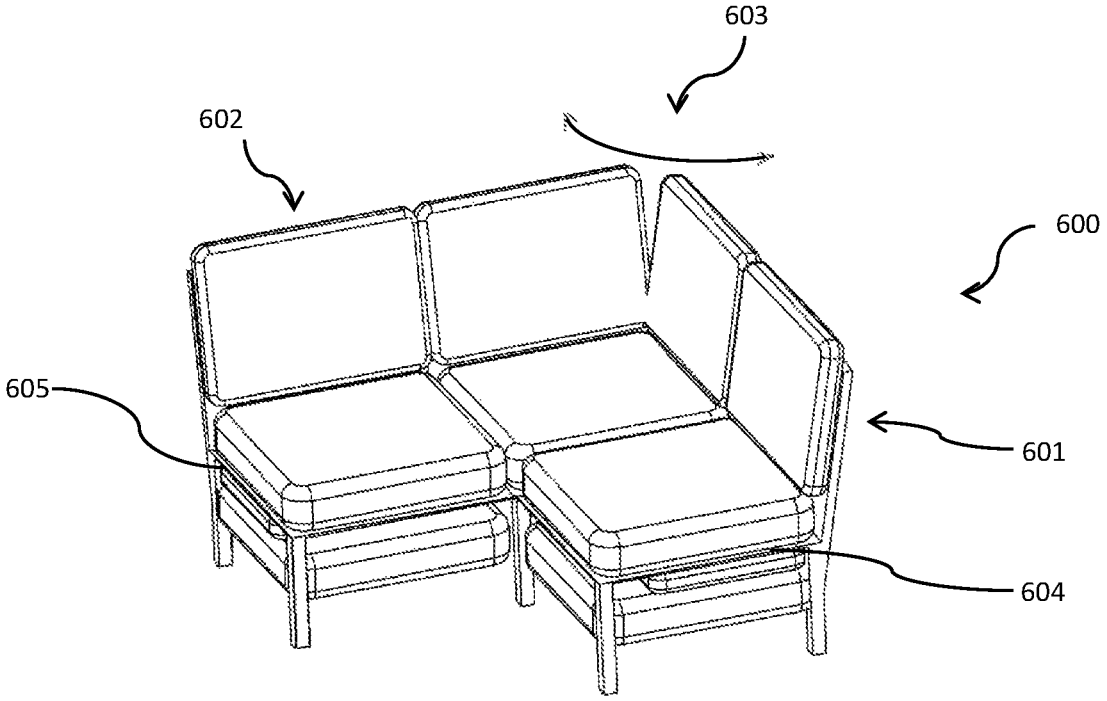
FIG. 26 is a perspective view of an exemplary corner sofa in an unexpanded (two-place-three-cushion) configuration.
Figure 27:
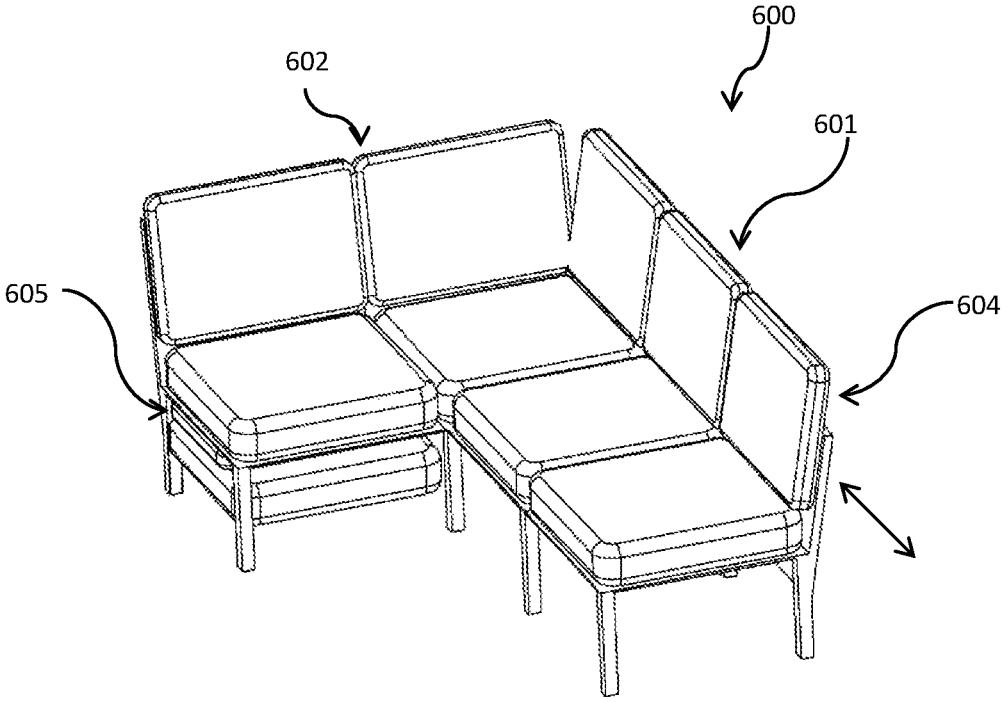
FIG. 27 is a perspective view of the exemplary sofa of FIG. 26 in a partially expanded (three-place-four-cushion) configuration.
Figure 28:
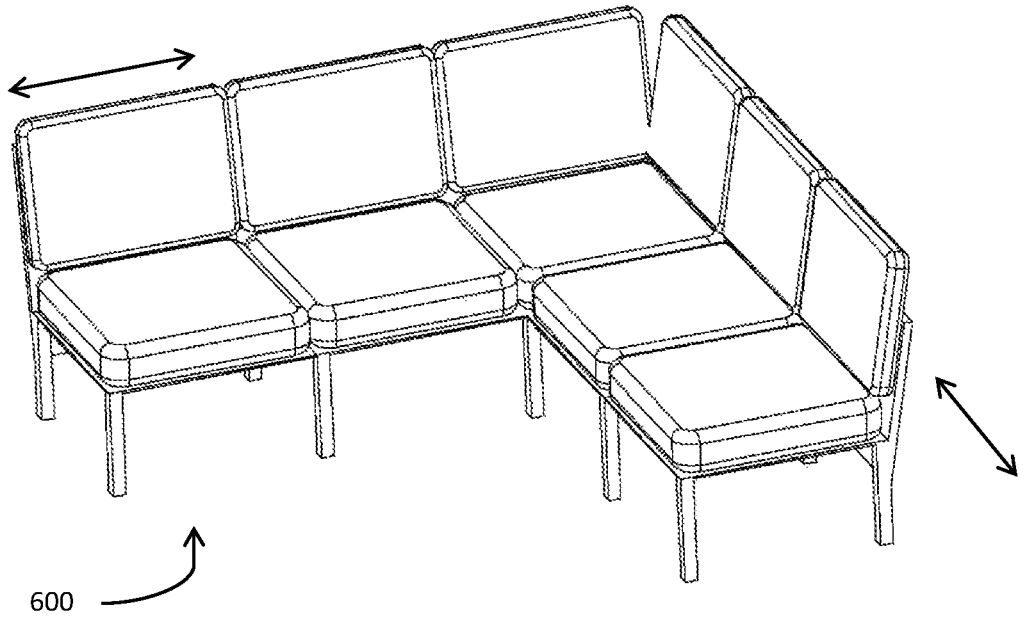
FIG. 28 is a perspective view of the exemplary sofa of FIG. 26 in a full-expanded (four-place-five-cushion) configuration.

Reference is now made concurrently to FIG. 26 to FIG. 28, which show perspective views of an exemplary expandable corner sofa 600. In the depicted example of FIG. 26 to FIG. 28, two center sections, 601 and 602 are provided with a corner section 603. The corner section 603 may be provided in different designs, as needed. It may for instance be round in order to provide more space for the center sections 601 and 602 and/or may provide a table or remote support, etc. The corner section 603 may also provide an adjustable angle between the center sections 601 and 602. Lateral sections 604 and 605 are respectively concealed inside the center sections 601 and 602. The corner sofa 6500 may be used in an unexpanded configuration. Of course, different cushion designs and/or material may be used. Cushions for the lateral sections 604 and 605 may be concealed under the center sections 601 and 602. FIG. 27 shows the corner sofa 600 in a partially expanded configuration with the lateral section 604 expanded and the cushions previously concealed under the center section 601 used on the support of the lateral section 604 to provide an additional seating position. FIG. 28 shows the corner sofa 600 in a 90-degree corner configuration with the center sections 601 and 602, corner 603 and lateral sections 604 and 605 expanded to create two (2) additional seating positions. The example of FIG. 26 to FIG. 28 may be used in many other configurations, e.g., shown with reference to the examples of FIG. 1 to FIG. 25.

Figure 29:
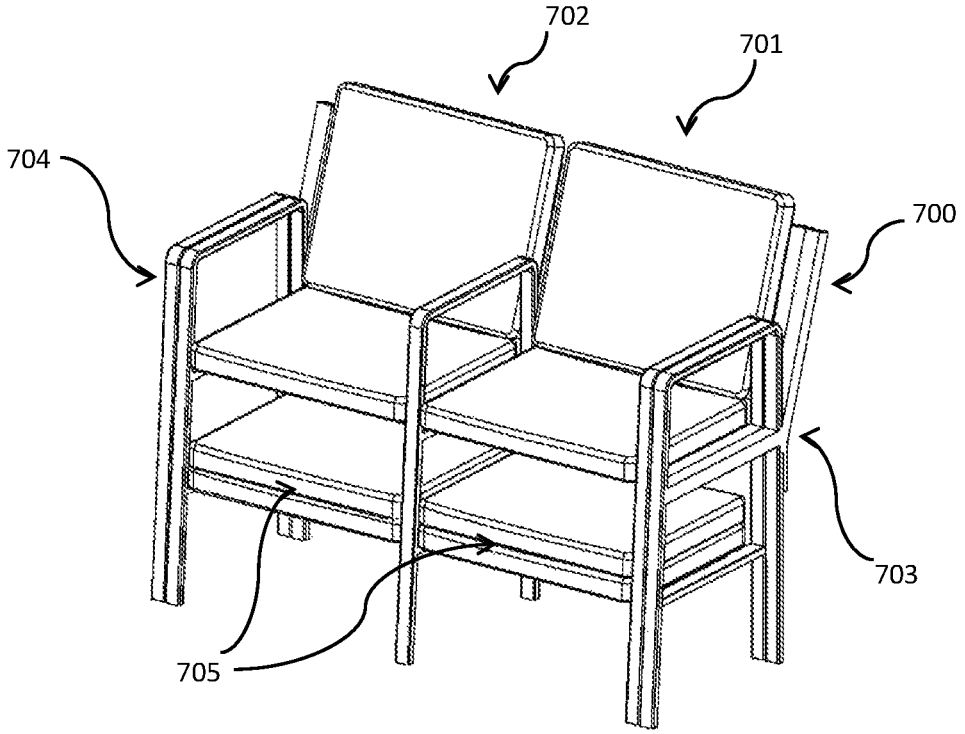
FIG. 29 is a perspective view of an exemplary chair in an unexpanded (two-place) configuration.
Figure 30:
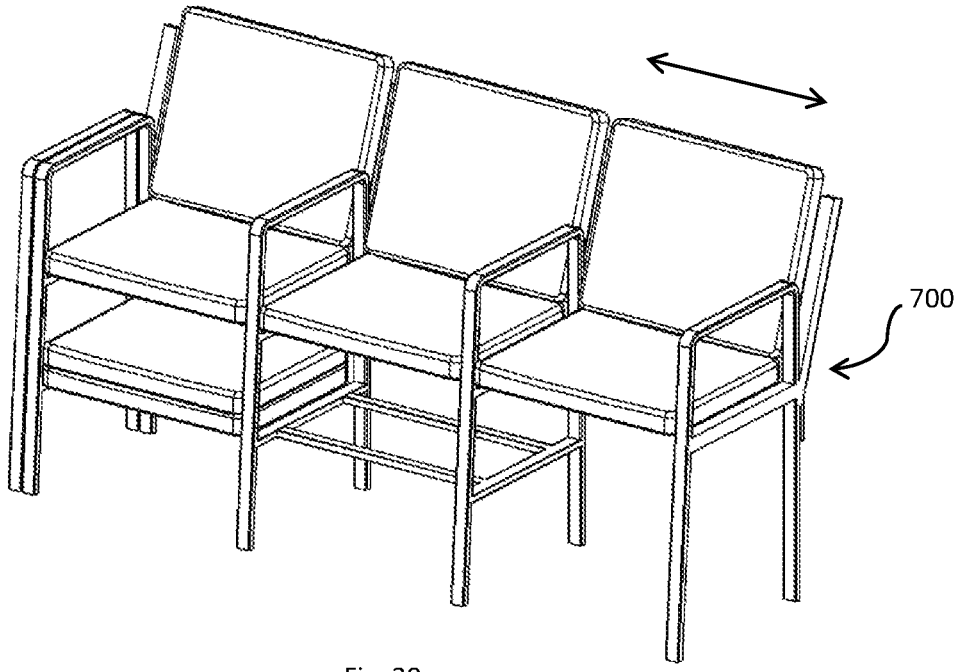
FIG. 30 is a perspective view of the exemplary chair of FIG. 30 in a partially-expanded (three-place) configuration.
Figure 31:
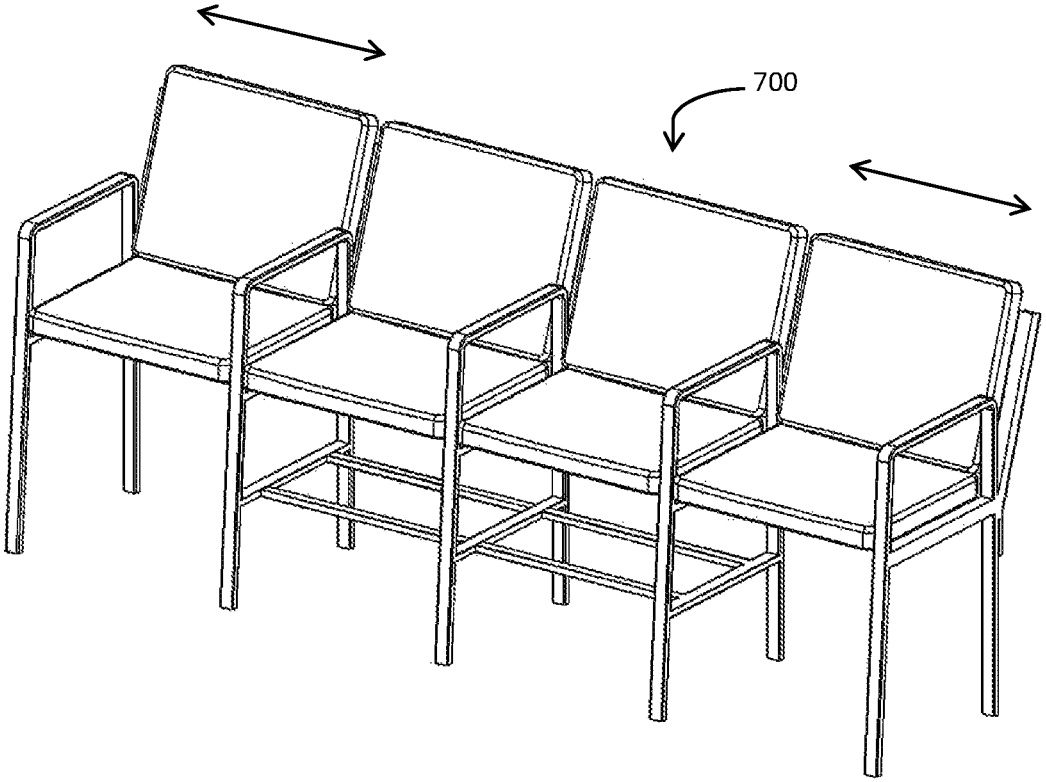
FIG. 31 is a perspective view of the exemplary chair of FIG. 30 in a fully-expanded (four-place) configuration.

Reference is now made concurrently to FIG. 29 to FIG. 31, which show perspective views of an exemplary chair 700 in accordance with embodiments of the present invention. The expandable chair 700 provides a two-place unexpanded configuration, which is depicted as comprising distinct center sections 701 and 702. The example of FIG. 29 to FIG. 31 may provide more storage space inside the center sections 701 and 702, e.g., for cushions, in turn allowing for thicker cushions providing better comfort or more cushions (plates) for more seating positions. As with the other embodiments depicted with reference to FIG. 1 to FIG. 28, the chair 700 may be provided in different designs, with or without armrest or a combination with armrest at extremities or any other configuration as needed. The chair 700 may also be made from steel, plastic, wood and/or any other material needed and in different shapes. The depicted chair 700 may also be used for conference chairs, chairs that can transform into sofas, on the balconies, etc. Lateral sections 703 and 704 are concealed inside the center sections 701 and 702 and the cushions are stored under the center sections 703 and 704. FIG. 30 shows the expandable chair 700 with two (2) center sections 701 and 702 and left a single lateral section 703 expanded with cushions to provide an additional seating position. FIG. 31 shows the expandable chair 700 in a fully-expanded configuration providing a total of four (4) seating positions, with cushions. The chair 700 may be provided with different number of seating positions and may further be configurable as mentioned previously with regards to other examples with a single side, or both sides, with none, one or more positions on each side. The example of FIG. 29 to FIG. 31 may be used in many other configurations, e.g., shown with reference to the examples of FIG. 1 to FIG. 28.

In preferred embodiments, the invention is a chair with a center section providing at least a first seating position and one or more lateral sections that provide one or more additional seating positions, depending on the desired configuration. The lateral supports can be stored or concealed inside the center section. Different solutions may be applied for concealing the lateral sections in the center section such as having a single plate per support, having tubes, bars, sliders, channels and/or cooperating slots and rods (that can have different shapes and/or numbers) that may further interlock between the lateral supports and the center section tubes, bars, channels, sliders or slots (that can have different shapes or numbers) that can slide one inside other or combinations of these solutions. The supports can have different designs, like simple tubes, bars, channels, rods, sliders, telescopic tubes, plates, etc. and be made from different materials. The lateral supports can have different designs, with or without armrest, which can take different shapes, from modern bars to cushions or cushions supports. This invention describes a chair that can be used as a single chair with one or more initial seating positions, and may further be expanded laterally in 1, 2, 3, 4, 5 or more additional seating positions with the help of lateral supports stored (concealed) inside the chair. The chair may optionally store (conceal) cushions not used under the main chair, in the back and/or inside the armrests. Skilled persons will readily acknowledge and recognize that different permutations of the features depicted with reference to one of the examples of FIG. 1 to FIG. 31 may readily be applied to one or more of the other depicted examples.

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses.

The invention claimed is:

1. An expandable seating furniture comprising:

a center section providing one or more first seating places along a single seating plane, the center section providing center chair legs and a center back support, the center section providing a cushion-storage compartment accessible from the front of the furniture;

at least one lateral section, concealable into the center section, each of the at least one lateral section being laterally expandable for providing one or more additional seating places along a single seating level, wherein the center section conceals a back portion for each of the at least one lateral section when the expandable seating furniture is unexpanded, wherein the center section and the at least one lateral section provide cooperating expandable mechanical connections, the cooperating expandable mechanical connections defining the single seating level along the single seating plane whether the furniture is expanded or unexpanded and wherein the cushion-storage compartment is located under the cooperating expandable mechanical connections;

one or more identical cushions for the one or more additional seating places concealable into the cushion-storage compartment of the center section when the expandable seating furniture is unexpanded; and wherein each of the one or more additional seating places, when expanded, is provided with a back portion that was previously concealed in the center section.

2. The expandable seating furniture of claim 1, wherein the cooperating expandable mechanical connections comprise two or more interleaved sliding sections concealable into the center section.

3. The expandable seating furniture of claim 2, wherein the interleaved sliding sections are stacked over one another along the single seating plane when the expandable seating furniture is unexpanded.

4. The expandable seating furniture of claim 2, wherein one of the interleaved sliding sections, when expanded in a first direction, is supported by at least one of the lateral chair legs and at least one of the center chair legs.

5. The expandable seating furniture of claim 4, wherein a second one of the interleaved sliding sections, when expanded in the first direction, is supported by at least two of the lateral chair legs, at least one of the at least two of the lateral chair legs being the at least one lateral chair supporting the first one of the interleaved sliding sections.

6. The expandable seating furniture of claim 2, wherein parallel slots are provided between the center section and the interleaved sliding sections along the single seating plane when the expandable seating furniture is unexpanded.

7. The expandable seating furniture of claim 6, wherein additional parallel slots and cooperating rods are provided between the interleaved sliding sections along the single seating plane.

8. The expandable seating furniture of claim 6, wherein at least some of the parallel slots are juxtaposed next to one another.

9. The expandable seating furniture of claim 6, wherein a first one of the interleaved sliding sections expanded in a first direction is supported by at least one of the lateral chair legs and at least one of the center chair legs.

10. The expandable seating furniture of claim 9, wherein a second one of the interleaved sliding sections expanded in the first direction is supported by at least two of the lateral chair legs, at least one of the at least two of the lateral chair legs being the at least one lateral chair supporting the first one of the interleaved sliding sections.

11. The expandable seating furniture of claim 2, wherein parallel slots and cooperating rods are provided between the center section and the interleaved sliding sections along the single seating plane when the expandable seating furniture is unexpanded.

12. The expandable seating furniture of claim 11, wherein at least some of the parallel slots and cooperating rods act together as rods for additional cooperating parallel slots along the single seating plane.

13. The expandable seating furniture of claim 1, further comprising arm rests, wherein at least one of the cushions is concealable in the arm rests.

14. The expandable seating furniture of claim 13, wherein the cushions are selectively concealable in the arm rests and into the cushion-storage compartment.

15. An expandable seating furniture comprising:

a center section providing one or more first seating places along a single seating plane, the center section providing center chair legs and a center back support;

at least one lateral section, concealable into the center section, each of the at least one lateral section being laterally expandable for providing one or more additional seating places along the single seating plane, wherein the center section conceals a back portion for each of the at least one lateral section when the expandable seating furniture is unexpanded;

one or more cushions for the one or more additional seating places concealable into the center section when the expandable seating furniture is unexpanded;

wherein each of the one or more additional seating places, when expanded, is provided with a back portion that was previously concealed in the center section;

a corner section, wherein the center section is provided on a first lateral side of the corner section;

a second center section provided on a second lateral side of the corner section; and one or more second lateral sections, concealable into the second center section, each of the second lateral sections being laterally expandable for providing one or more second additional seating places.

16. An expandable seating furniture comprising:

a center section providing one or more first seating places along a single seating plane, the center section providing center chair legs and a center back support;

at least one lateral section, concealable into the center section, each of the at least one lateral section being laterally expandable for providing one or more additional seating places along the single seating plane, wherein the center section conceals a back portion for each of the at least one lateral section when the expandable seating furniture is unexpanded;

one or more cushions for the one or more additional seating places concealable into the center section when the expandable seating furniture is unexpanded;

wherein each of the one or more additional seating places, when expanded, is provided with a back portion that was previously concealed in the center section; and wherein armrests of the lateral sections are concealed into armrests of the center section when the expandable seating furniture is unexpanded.

* * * * *